United States Patent [19]

Baublitz

[11] 4,155,465

[45] May 22, 1979

[54] AUXILIARY CLOTHES HANGER SUPPORT

[76] Inventor: Harvey W. Baublitz, 15042 Rolling Ridge Dr., Chino, Calif. 91710

[21] Appl. No.: 901,504

[22] Filed: May 1, 1978

Related U.S. Application Data

[62] Division of Ser. No. 726,929, Sep. 27, 1976.

[51] Int. Cl.[2] ..... A47H 1/00

[52] U.S. Cl. ..... 211/123; 108/31; 211/86; 211/105.3

[58] Field of Search ..... 108/31, 30, 29; 211/86, 211/123, 105.1, 105.2, 105.3; 248/251

[56] References Cited

U.S. PATENT DOCUMENTS

| | | | |
|---|---|---|---|
| 1,439,789 | 12/1922 | Bensinger | 211/86 |
| 1,537,242 | 5/1925 | Lukins | 211/105.3 |
| 2,277,954 | 3/1942 | Clouse | 211/123 |
| 2,825,469 | 3/1958 | Watkins et al. | 211/105.3 |

*Primary Examiner*—Francis K. Zugel
*Attorney, Agent, or Firm*—Boniard I. Brown

[57] ABSTRACT

An auxiliary clothes hanger support for attachment to a shelf in a clothes closet or the like to increase the clothes storage capacity of the closet. The support has a bracket to be secured to the shelf and a normally horizontal hanger support rod slidable endwise in the bracket for forward extension of the rod beyond the front edge of the shelf to provide a clothes hanger support and rearward retraction of the rod to an out of the way position when not in use.

4 Claims, 6 Drawing Figures

AUXILIARY CLOTHES HANGER SUPPORT

This is a division, of application Ser. No. 726,929, filed Sept. 27, 1976.

BACKGROUND OF THE INVENTION

Field of the Invention: This invention relates generally to clothes hanger supports and more particularly to an auxiliary hanger support for attachment to the shelf of a clothes closet or the like to increase effective clothes storage capacity of the closet.

Discussion of the Prior Art: Clothes storage presents a perpetual problem in most homes. Moreover, this problem is a perpetual one which continues to increase every year owing to the ever increasing emphasis or fashion and the ever increasing range or variety of wearing apparel available for both men and woman.

A variety of clothes storage arrangements have been devised for homes and apartments in order to alleviate this problem. However, no matter what the clothes storage capacity, it never seems to be enough. As a consequence, there is a continuous demand for wyas to increase such clothes storage capacity.

One way of accomplishing such increase in storage capacity is to provide a closet with additional or auxiliary clothes hanger supports. A variety of auxiliary supports for this purpose and for similar purposes have been devised. Examples of such auxiliary supports, for instance, are described in U.S. Pat. Nos. 433,907, 2,472,480, 2,576,067, 2,905,423, and 2,916,158.

SUMMARY OF THE INVENTION

This invention provides an improved clothes hanger support of the character described. Simply stated, this hanger support comprises a bracket having a base to be secured to a shelf in a clothes closet, or the like, adjacent the front edge of the shelf. Projecting above the base is an upper bracket portion slidably mounting a normally horizontal hanger support rod.

This hanger support rod is slidable endwise in the hanger support bracket between a forward extended position and a rearward retracted position. In its extended position, the hanger support rod projects forwardly beyond the front edge of the closet shelf to which the bracket is attached for supporting a number of clothes hangers beyond the front edge of the shelf, such that clothes on the hangers hang freely in front of the shelf. In its retracted position, the hanger rod is retracted rearwardly to an out-of-the way position such as to not interfere with normal use of the closet.

Two presently preferred embodiments of the invention are described. In one embodiment, the hanger support bracket is fashioned from a metal strap having upstanding front and rear portions containing aligned holes which slidably receive the hanger support rod. In the second described embodiment, the hanger support bracket is forged or cast and includes an upper plate-like web bounded about its perimeter by a transverse flange and containing holes which extend through the flange and edgewise through the web to slidably receive the hanger support rod.

DESCRIPTION OF THE PREFERRED EMBODIMENTS

Figures 1, 2, 3, 4, 5, 6:
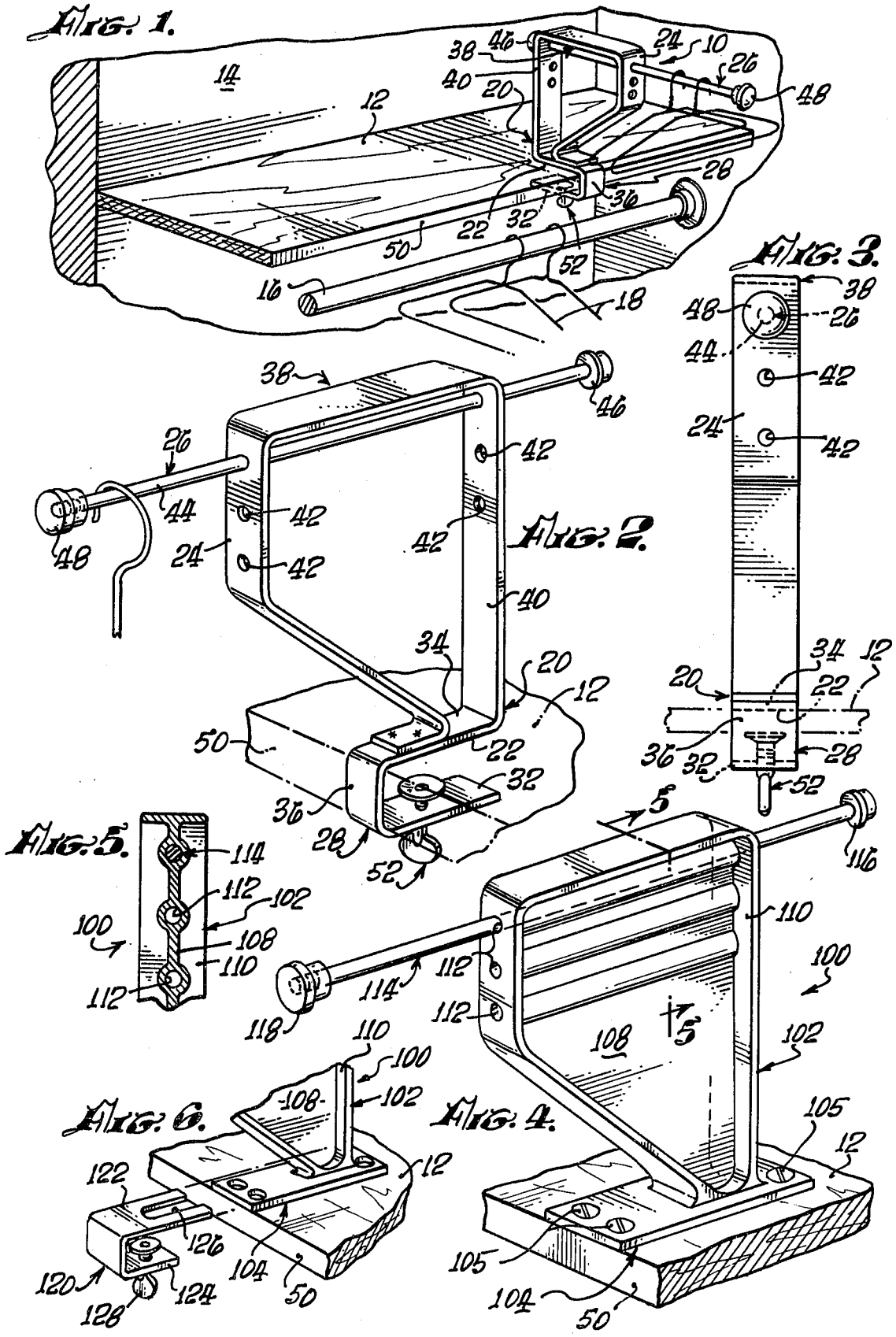
FIG. 1 is a perspective view of a preferred auxiliary clothes hanger support according to the invention installed on the shelf of a clothes closet.
FIG. 2 is an enlarged perspective view of the hanger support.
FIG. 3 is a front view of the support.
FIG. 4 is a perspective view of a modified auxiliary clothes hanger support according to the invention.
FIG. 5 is a section taken on line 5—5 in FIG. 4.
FIG. 6 illustrates an alternative method of attaching the auxiliary clothes hanger support of FIGS. 4 and 5 to a closet shelf.

Turning first to FIGS. 1 and 3 of these drawings, there is illustrated an auxiliary clothes hanger support 10 according to the invention attached to the shelf 12 of a clothes closet 14. In a typical clothes closet, shelf 12 is fixed in a horizontal position some distance above a hanger support rod 16. This hanger support rod extends horizontally across the closet to support a number of clothes hangers 18, with or without garments, side by side.

Referring particularly to FIGS. 2 and 3, the auxiliary clothes hanger support 10 comprises a mounting bracket 20 having a base surface 22 and a normally upright front side 24. A hanger support rod 26 is slidable endwise in the base 20, in the fore and aft direction of the base, with the axis of the rod substantially parallel to the base surface 22 of the mounting bracket. Hanger support rod 26 is slidable endwise in and forwardly of the mounting bracket 20 to its extended position of FIG. 1, wherein the front end of the rod projects a maximum distance beyond the front side 24 of the bracket. The support rod is slidable rearwardly in the base to an out-of-the-way retracted position, wherein the front end of the rod projects a minimal distance beyond the front side of the bracket.

At the bottom of the hanger support or mounting bracket 20 are means 28 for attaching the bracket to the closet shelf 12 with the bracket base surface 22 seating on the shelf, as shown. In the installed position of the auxiliary clothes hanger support 10, the support bracket 20 is located adjacent the front edge 50 of the shelf 12 with the bracket and its hanger support rod 26 disposed in a fore and aft plane of the shelf. When the hanger support rod 26 is extended to its position of FIG. 1, the front end of the rod projects a distance beyond the front edge 50 of the shelf 12 to support clothes hangers beyond the front edge, as shown. When the hanger support rod is retracted, its front end is retracted to a position close to the front side 24 of the bracket 20, such that the rod does not interfere with normal use of the closet. As will be explained presently, the support rod 26 may be vertically adjustable relative to the bracket 20 to adjust the elevation of the rod above the closet shelf 12.

Referring now in more detail to the particular auxiliary hanger support 10 illustrated in FIGS. 1 through 3, the support bracket 20 is fashioned from a metal strap having a flat end portion 32 and an adjacent flap portion 34 disposed in spaced parallel relation and joined at one end by a connecting portion 36 of the strap to form a yoke-like configuration which constitutes the bracket base 28. The undersurface of the upper strap portion 34 provides the base surface 22. The bracket strap extends upwardly from the rear end of the upper strap portion 34, then forwardly over and lengthwise of the strap portion 34 to a position some distance forwardly of the bracket base 28, then vertically downward toward the base, and finally downwardly and rearwardly to the upper strap portion 34 of the base. The lower extremity of the rearwardly inclined strap portion is spot welded or otherwise rigidly secured to the upper bracket base portion 34, as shown. Thus, the hanger support bracket 20 has an upper, generally loop shaped portion 38 above and disposed in a fore and aft plane of the bracket base 28. The vertical strap sections of the upper bracket portion 38 provide the front side 24 and an opposite rear side 40, respectively, of the hanger support bracket 20.

Extending through the bracket sides 24, 40 are aligned holes 42 for slidably receiving the hanger support rod 26. As shown, this support rod has a cylindrical rod 44 proper with shoulders 46 and 48 at the rod ends. Shoulder 46 is rigidly attached to the rear end of the rod. Shoulder 48 is threaded on the rod, as shown, so as to be removable from the rod. Rod 44 is selectably insertable through any one of the three sets of aligned bracket holes 42, which hole sets are disposed one over the other in the manner shown to permit vertical adjustment of the hanger support rod 26 relative to the bracket base 28.

The spacing between the lower and upper strap portions 32, 34 of the bracket base 28 is slightly greater than the thickness of the closet shelf 12 on which the auxiliary hanger support 10 is to be installed. Accordingly, the bracket base 28 is adapted to be placed in straddling relation to the front edge 50 of the shelf, as shown best in FIG. 2. Threaded in the lower strap portion 32 of the base is a clamp screw 52 for clamping the base to the shelf.

The auxiliary clothes hanger support 10 is installed on the shelf 12 by backing off the bracket clamp screw 52 and placing the bracket base 28 over the front edge 50 of the shelf, with the base surface 22 resting on the upper side of the shelf, as shown in FIG. 2. The base clamp screw 52 is then threaded upwardly against the underside of the shelf to firmly clamp the hanger support brackets 20 to the shelf. When the bracket 20 is thus installed on the shelf 12, the upper bracket portion 38 projects forwardly some distance beyond the front edge 50 of the shelf, such that the front side 24 of the bracket is located beyond the front edge of the shelf. The auxiliary hanger support 10 is conditioned for supporting clothes hangers by extending by the hanger support rod 26 forwardly to its position of FIG. 1. In this position, the rod projects forwardly of the front shelf edge 50 to permit clothes to be hung in front of the shelf. When the auxiliary hanger support is not in use, the hanger support rod 26 is retracted rearwardly to locate the rod out of the way so as not to interfere with normal use of the closet. As noted, the hanger support rod 26 is selectably insertable in the bracket holes 42 by removing the front rod shoulder 48, thus to permit vertical adjustment of the hanger rod relative to the closet shelf 12.

Turning now to FIGS. 4 and 5, the illustrated auxiliary clothes hanger support 100 is similar to the auxiliary support 10 just described and includes a mounting or hanger support brackets 102, having a lower mounting base 104 and an upper bracket portion 106. The bracket base 104, in this case, is essentially a flat plate having holes for receiving mounting screws 105. The upper bracket portion 106 is essentially identical in outline with the upper bracket portion 38 of the auxiliary clothes hanger support 10 and includes a plate-like web 108 bounded about its edge by a transverse flange 110. The bracket web 108 is disposed in a fore and aft plane of the base 104. The bracket flange 110 projects beyond opposite sides of the web 108.

Extending edgewise through the bracket web 108 and through the flange 110 are holes 112 for selectably receiving the hanger support rod 114 of the auxiliary hanger support 100. As in the case of the auxiliary hanger support 10, the hanger support rod 114 has shoulders 116, 118 at its ends to limit endwise movement of the rod relative to the bracket 102. The front shoulder 118 is removable for insertion of the hanger support rod 114 into any one of the bracket holes 112, thus to permit vertical adjustment of the rod relative to the bracket mounting base 104.

The modified auxiliary hanger support bracket 110 is installed in much the same way as the auxiliary hanger support 10, except that the mounting base 104 of the hanger support 100 is secured by the screws 108 to the upper surface of the shelf. As in the case of the hanger support 10, the bracket 102 of the hanger support 100 is installed adjacent the front edge 50 of the shelf 12, such that the hanger support rod 114 is extendable forwardly beyond the edge to support clothes hangers and is retractable rearwardly to an out of the way position. As it may be best observed in FIG. 4, the web 108 of the hanger support bracket 102 is thickened in the region of the support rod holes 112 to provide sufficient material for these holes to extend through.

In some cases it may be undesirable to use screws for attaching the auxiliary clothes hanger support 100 to the shelf 12 by means of the screws 108. In this case, a clamp bracket 120 may be utilized for securing the bracket base 104 to the shelf, as shown in FIG. 6. This clamp bracket has upper and lower legs 122, 124 which are adapted to straddle the front edge 50 of the closet shelf 12 and the mounting base 104 of the auxiliary clothes hanger support 100. The upper leg is slotted at 126 to straddle the lower end of the upper hanger bracket portion 106. The lower clamp bracket leg 124 carries a clamp screw 128 for securing the clamp bracket and thereby the hanger support mounting base 104 to the shelf 12.

I claim:

1. An auxiliary clothes hanger support for attachment to a shelf having an exposed edge comprising:

a mounting bracket having a base surface and a normally upright front side, said bracket including a flat normally lower base having said base surface for seating on said shelf and an upper bracket portion above and projecting forwardly of said base and having said front bracket side and an opposite rear bracket side, said upper bracket portion including a normally upright plate-like web in a fore and aft plane of said base and a flange about and projecting beyond opposite sides of said web, and a hole through said flange and edgewise through said web slightly receiving said rod, a hanger support rod slidable endwise in said hole in the fore and aft direction of the base with the rod axis parallel to said base surface for extension of said rod in the forward direction to an extended hanger supporting position wherein the front end of said rod projects beyond said front bracket side and for rearward retraction of said rod to a position wherein the front end of said rod is adjacent said front bracket side, and means for mounting said bracket on said half adjacent said shelf edge with said bracket base surface seating on the shelf and said front bracket side adjacent and facing in the same direction as said shelf edge, wherein in said extended position of said hanger support rod, said front rod end projects beyond said shelf edge to support clothes beyond said front shelf edge.

2. An auxiliary clothes hanger support according to claim 1, wherein said upper bracket portion includes a plurality of said holes at different elevations relative to said base to permit vertical adjustment of said rod relative to said base.

3. An auxiliary clothes hanger support according to claim 2, wherein:

said rod extends beyond said front and rear bracket sides and includes shoulders at its ends for limiting endwise movement of said rod relative to said bracket, and one of said rod shoulders is removable for selective insertion of said rod into said bracket holes.

4. An auxiliary clothes hanger support according to claim 3, wherein:

said bracket base, web, and flange form a unitary bracket structure.

* * * * *